United States Patent [19]

Winston et al.

[11] 4,157,827

[45] Jun. 12, 1979

[54] HAND GRIP FOR JUMP ROPE AND SIMILARLY-GRIPPED EXERCISE DEVICES

[76] Inventors: Edith Winston; Herbert Winston, both of 135 Hazelwood Dr., Jericho, N.Y. 11753

[21] Appl. No.: 805,516

[22] Filed: Jun. 10, 1977

[51] Int. Cl.[2] ..... A63B 5/20

[52] U.S. Cl. ..... 272/75; 272/117; 272/143

[58] Field of Search ..... 272/75, 74, 67, 68, 272/116, 117, 118, 122, 123, 124, 130, 143, DIG. 4; 273/81 R, 81 A, 81 B, 81 C, 81 D, 68, 72 R, 75, 67 R; 74/551.9, 558.5; 16/110 R, 110.5

[56] References Cited

U.S. PATENT DOCUMENTS

| | | | |
|---|---|---|---|
| 729,064 | 5/1903 | Hale | 272/68 |
| 1,304,647 | 5/1919 | Basta | 273/81 A UX |
| 1,638,003 | 8/1927 | Neumann | 272/67 X |
| 1,666,201 | 4/1928 | Goldstein | 272/75 |
| 2,509,810 | 5/1950 | Gore, Jr. | 272/122 |
| 2,869,872 | 1/1959 | Nissen | 272/75 |
| 3,189,069 | 6/1965 | Stowell | 273/81 R X |
| 3,212,777 | 10/1965 | Spoczynski | 272/75 |
| 3,226,115 | 12/1965 | Underhill | 272/122 |
| 3,542,363 | 11/1970 | Bishop et al. | 272/68 |
| 3,897,058 | 7/1975 | Koch | 273/81 R X |
| 3,964,340 | 6/1976 | Antonio | 273/81 R X |

FOREIGN PATENT DOCUMENTS

| | | | |
|---|---|---|---|
| 1194124 | 6/1970 | United Kingdom | 273/81 R |

*Primary Examiner*—Richard C. Pinkham
*Assistant Examiner*—Arnold W. Kramer
*Attorney, Agent, or Firm*—Bauer & Amer

[57] ABSTRACT

A hollow hand grip for a jump rope or other similarly-gripped exercise device, in which one or more exercise weights can be used; said hand grip including, specifically for the contingency when less than all weights are used, an end plug which effectively maintains the end wall thereof in its shape and location to correspondingly maintain this end wall in its frictional engagement with the closure for the compartment for the weights defined within the hand grip, thus contributing to the safety in using said weighted hand grip.

2 Claims, 5 Drawing Figures

HAND GRIP FOR JUMP ROPE AND SIMILARLY-GRIPPED EXERCISE DEVICES

The present invention relates generally to an improved weighted hand grip for a jump rope or similar exercise device, and more particularly to improvements contributing to safe use thereof, particularly when the hand grip is filled with less than all of its cooperating exercise weights.

In the contingency noted, i.e. when the hand grip is not completely filled with exercise weights, it is unavoidable that the gripping pressure applied to the hand grip will cause its collapse into a shape determined by its internal volume that is occupied by whatever weights are used. This shape distortion in the hand grip, unless properly dealt with, can result in inadvertent disassembly of the components of the hang grip, inadvertent release of the exercise weights, and other such undesirable consequences. In prior art weighted hand grips to obviate the foregoing has resulted in an overly complex and costly construction of the hand grip.

Broadly, it is an object of the present invention to provide an improved weighted hand grip for a jump rope or other such exercise device overcoming the foregoing and other shortcomings of the prior art. Specifically, it is an object to provide a simple, hollow tube as the hand grip, having a friction fitting cap, and simple means for maintaining the cap on the tube despite the distortion occurring in the tube when it is squeezed with less than all of the exercise weights within it.

Intended for use with a jump rope or similarly-gripped exercise device, a hand grip demonstrating objects and advantages of the present invention includes a hand-sized hollow pliable plastic body member defining a storage compartment for exercise weights. A circular edge at one end of the body member bounds an access opening into the storage compartment for the placement into and removal of said exercise weights from the compartment. Included in the hand grip assembly is a plug of rigid construction material that is inserted within the access opening and thus is in a supporting position beneath the circular edge, and thus the plug can, and does, maintain the shape of the opening and the shape of the wall adjacent to it. Completing the hand grip is an outer closure member sized to provide a friction fit when placed in covering relation over the supported circular edge. In the contingency therefore, when less than all the exercise weights are in use in the compartment allowing a collapse therein, the closure member is nevertheless maintained in its position closing the access opening due to the plug maintaining the shapes of the edge and closure member, and thus these two components frictionally engaged to each other.

The above brief description, as well as further objects, features and advantages of the present invention, will be more fully appreciated by reference to the following detailed description of presently preferred, but nonetheless illustrative embodiments in accordance with the present invention, when taken in conjunction with the accompanying drawings, wherein:

FIG. 1 is a partial exploded perspective view illustrating the components that comprise one of the hand grips of the jump rope;

FIG. 2 is a perspective view illustrating an assembled hand grip without one of the essential components thereof and the adverse result produced as a consequence thereof;

FIG. 3 is a side elevational view in section, on an enlarged scale, illustrating structural features of the improved hand grip hereof and of the improved result provided by same;

FIG. 4 is a perspective view illustrating typical use of the jump rope with the improved hand grips hereof.

Figure 4:
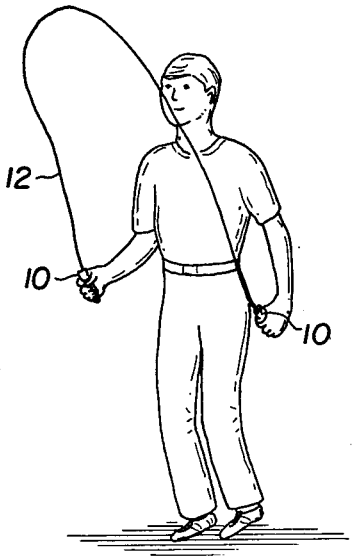
Figure 5:
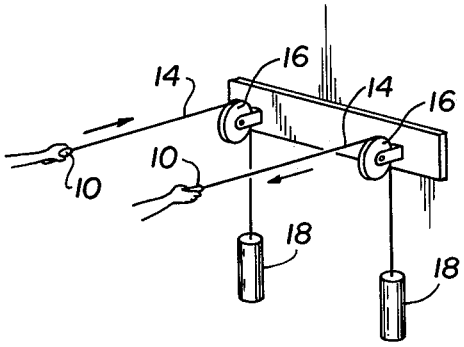
FIG. 5 is a perspective view illustrating the same hand grip of the previous figures but applied to another type of exercise device.

The invention resides in improved hand grips that are particularly suitable for exercise devices. The exercise devices most suitable are those that include a rope or cable as one component to which the within improved hand grip is attached. Thus, as illustrated in FIG. 4, the primary contemplated end use of the present invention is as the left and right-hand grips 10 of a jump rope 12. As shown in FIG. 5, however, it is also contemplated that the hand grips 10 hereof can be advantageously attached to one end of cables or ropes 14 which are entrained over wall-mounted pulleys 16 and are attached at their opposite end to exercise weights 18.

The beneficial use of the improved hand grips 10 hereof, whether applied to a jump rope 12 or the weight-lifting device of FIG. 5 or some other similarly-gripped exercise device, resides in the fact that one or more additional exercise weights can be inserted in the hand grip 10 to thereby contribute to the exercise routine. While the use of a weight in a hand grip has been used before, its use has been limited and restricted. More particularly, prior art weighted hand grips use only a specific designated weight that is appropriately permanently incorporated in the hand grip and thus is not subject to change. In contrast, the user of the within hand grips is given the option of how many exercise weights to use. Moreover, if less than all of the exercise weights are used, and thus the storage compartment for the weights is obviously not filled, there is no danger of the weights moving around in the storage compartment and somehow inadvertently being released therefrom during the exercise routine. The foregoing and other significant beneficial aspects of the improved hand grip will be understood from the description thereof now to be provided with specific reference to FIGS. 1–3.

When applied to a jump rope 12, the end of the rope is appropriately fitted with an improved hand grip, generally designated 10, the end of the jump rope being attached thereto, as at 20, in any appropriate manner. One method of attachment could simply be the insertion of the rope 12 through an opening sized to accommodate same and then knotting the end of the rope so that it cannot be pulled back through the opening. Hand grip 10 includes a tubular hollow body member 22 preferably fabricated of a soft plastic, such as polyvinyl chloride. This material of construction for hand grips already has a wide acceptance and favorable connotation, being used as hand grips for bicycles and the like. In the specific use contemplated herein, however, the hand-size tube 22 provides a cylindrical storage compartment 24 to which access is readily obtained through the circular-shaped end opening 26 that is bounded by the edge of the tube 22. Thus, it should be noted that edge 26 is circular in shape and has a specific diameter size.

Compartment 24 is intended to be used for the placement therein of one or more exercise weights 28 and 30.

Naturally, weights 28 and 30 are sized so that when both are used they fill the compartment 24 and there is no particular problem in maintaining these two weights in place during use of the exercise device. Specifically, it is a relatively simple matter to merely use cap 32 as a closure for the opening 26 to retain the two weights 28 and 30 in place, said closure 32 being sized of course to provide a friction fit between its cylindrical wall 34 and the external wall portion 36 adjacent the opening 26.

Figure 2:
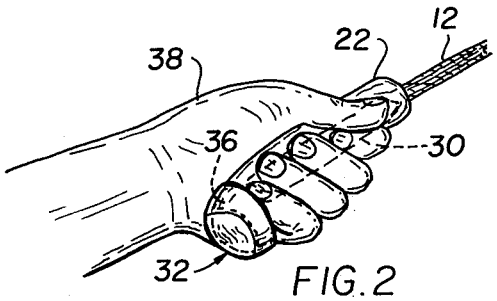
Figure 3:
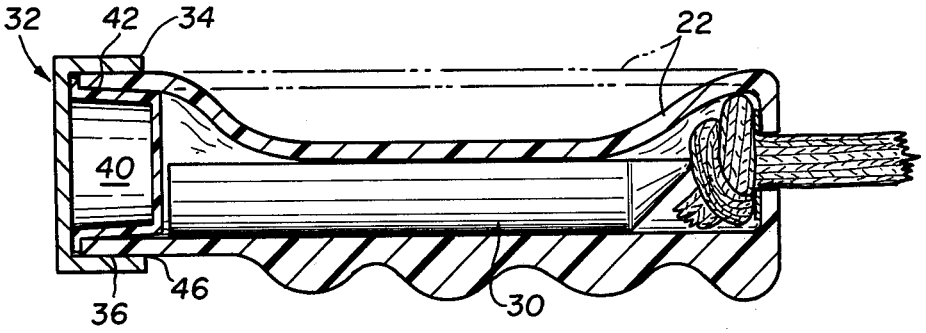

A serious problem occurs, however, when less than both of the weights 28 and 30 are used. This problem is illustrated in FIG. 2 which will be understood to illustrate use of the hand grip with only the one exercise weight 30. As shown in FIG. 2, when only the one weight 30 is used, it is unavoidable that the gripping pressure applied by the user's hand 38 will cause a change in the tube 22 from its usual cylindrical shape to a diminished shape in which it is collapsed about the single weight 30.

The collapsing of the tube 22 causes distortion in the end opening of this member and this in turn, as illustrated in exaggerated form in FIG. 2, contributes to movement of the surface portion 36 within the closure 32, and thus movement of wall portion 36 out of frictional engagement with the closure wall 34. With the lessening of the frictional inter-engagement of the closure 32 on the end of the member 22, there is the possibility that when the user lessens his gripping pressure on the member 22, that the weight within the hand grip will dislodge the closure 32 from the member 22, and that the weight itself will be inadvertently released from within the hand grip.

Figure 1:
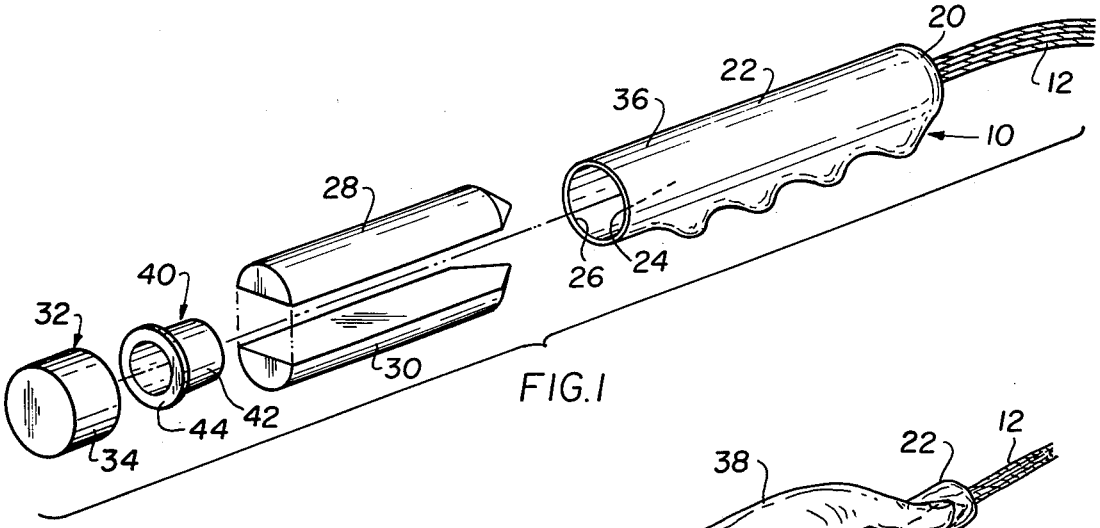
FIGS. 1–4 illustrates a first embodiment of the invention wherein the improved hand grips hereof are applied to a jump rope. More particularly.

As an effective solution obviating the adverse consequences from occurring when use is made of less than all of the exercise weights, the improved hand grip 10 hereof contemplates the additional use, as illustrated in FIG. 1, of a plug 40, preferably fabricated of a rigid plastic material. Plug 40 includes a cylindrical body 42 and has a small flange 44 that is intended as a convenient hand grip for removal of the plug 40. As may be readily appreciated from FIG. 3 in conjunction with FIG. 1, the function of the plug 40 is one during which, when in its inserted operative position within the opening 26, the cylindrical wall 42 thereof assumes a position supporting the tubular wall portion 36 in its circular shape. Thus, when the closure 32 is placed over plug 40, the internal surface of its cylindrical wall 34 establishes a frictional gripping contact with said wall portion 36 that is supported and maintained in a circular configuration, as well as in a position in surface contact therewith. To demonstrate this, the interface of the surfaces 34 and 36 is designated by the reference numeral 46 in FIG. 3. Thus, even if only a single exercise weight 30 is used, the collapsing of the tube 22 from its phantom line into its full line condition does not correspondingly produce any distortion in the closed end of the tube 22 because of the presence therein of the plug 40, all as is clearly illustrated in FIG. 3. Thus, by maintaining the contacting surfaces of the walls 34 and 36 frictionally engaged to each other at their interface 46, the closure 32 is maintained firmly in position closing the compartment opening 26 and thus obviating any possibility of inadvertent release of the exercise weight 30 from this compartment.

From the foregoing it should be readily appreciated that there has been described herein an improved hand grip particularly suited for exercise devices in which the user can be given an option as to the amount of weights to use in the hand grip since less than all of the exercise weights can be safely used, as already noted. It should also be noted that a latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. As an improvement for a jump rope, a hand grip attached to said jump rope comprising a hand-sized hollow cylindrical pliable body member of the type that is squeezable by externally-applied pressure to a diminished diameter defining a storage compartment for exercise weights, a circular edge at one end of said body member bounding an access opening into said storage compartment for the placement and removal of said exercise weights, a plug of rigid construction material having an inserted operative position with said access opening in supported relation beneath said circular edge so as to maintain said shape thereof, and an outer closure member sized to provide a friction fit when placed in covering relation over said supported circular edge, whereby when less than all said exercise weights are in use in said compartment allowing a collapse therein said closure member nevertheless maintains said position closing said access opening due to said plug maintaining said edge and closure member frictionally engaged to each other.

2. An improved hand grip as claimed in claim 1, wherein said body member and said closure member are fabricated of pliable plastic to contribute both to comfort in use and to establishing said frictional gripping therebetween.

* * * * *